US006532936B1

(12) United States Patent
Thomson

(10) Patent No.: US 6,532,936 B1
(45) Date of Patent: Mar. 18, 2003

(54) SYSTEM AND METHOD FOR ALTERING ENGINE IGNITION TIMING

(75) Inventor: Steven Douglas Thomson, El Paso, TX (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/013,055

(22) Filed: Oct. 30, 2001

(51) Int. Cl.[7] ..... F02P 5/08

(52) U.S. Cl. ..... 123/406.58; 123/406.11; 73/116; 73/117.3

(58) Field of Search ..... 123/406.58, 406.11; 73/116, 117.3

(56) References Cited

U.S. PATENT DOCUMENTS 4,580,446 A * 4/1986 Ansteth ..... 116/DIG. 21
5,165,271 A * 11/1992 Stepper et al. ..... 73/116
5,933,005 A * 8/1999 Pugh ..... 324/207.23
6,208,131 B1 * 3/2001 Cebis et al. ..... 123/406.58

* cited by examiner

*Primary Examiner*—Bibhu Mohanty
(74) *Attorney, Agent, or Firm*—Margaret A. Dobrowitsky

(57) ABSTRACT

A method for altering engine ignition timing includes removing a centered gear tooth sensor from an engine. The centered gear tooth sensor is replaced with an offset gear tooth sensor. The offset gear tooth sensor includes a sensing element that forms a sensing angle, α, with respect to a center diametric axis defined by a target wheel. The engine ignition timing is altered by an angular amount equal to the sensing angle, α, of the sensing element.

14 Claims, 1 Drawing Sheet

SYSTEM AND METHOD FOR ALTERING ENGINE IGNITION TIMING

TECHNICAL FIELD

The present invention relates generally to engine ignition systems.

BACKGROUND OF THE INVENTION

Typically, when the assembly of a motor vehicle is complete, the vehicle leaves the factory with the engine having a predetermined ignition timing. In certain climates, the engine timing can be advanced in order to enhance the performance of the engine. Moreover, the engine timing can be advanced if the driver wishes to purchase higher octane fuel in order to increase the engine performance.

The conventional way to advance the ignition timing, e.g., five to six degrees (5°–6°), is to purchase a high performance aftermarket ignition control chip, remove the stock ignition control chip from the engine control module (ECM), and install the high performance chip in the ECM. For engines that have distributors, the stock distributors can be removed and replaced with mechanical advance distributors. These mechanical advance distributors mechanically advance the ignition timing at certain engine speeds (RPM). Also, the base timing of a distributor can be advanced by manually adjusting the distributor until the desired ignition advance is achieved. Each of these above solutions will advance the ignition timing. However, purchasing an aftermarket chip can be relatively expensive. Similarly, purchasing a mechanical advance distributor can also be relatively expensive. Moreover, a mechanical advance distributor or manually adjusting the distributor can only be used to advance the ignition timing of vehicles that have distributions. Since many vehicles manufactured today do not use distributors, these solutions cannot be used to advance the ignition timing.

The present invention has recognized these prior art drawbacks, and has provided the below-disclosed solutions to one or more of the prior art deficiencies.

SUMMARY OF THE INVENTION

A method for altering the ignition timing of an engine includes shutting the engine off and removing a centered gear tooth sensor from the engine. The centered gear tooth sensor is replaced with an offset gear tooth sensor.

In a preferred embodiment, the offset gear tooth sensor either advances or retards the ignition timing. Preferably, the engine includes a target wheel attached to a rotating shaft. The target wheel defines a center diametric axis and the offset gear tooth sensor includes a sensor housing that is aligned with the center diametric axis. The sensor also includes a sensing element that forms a sensing angle with respect to the center diametric axis.

In another aspect of the present invention, an engine control system includes a microprocessor and an ignition system electrically connected thereto. An offset gear tooth sensor is also connected to the microprocessor. The offset gear tooth sensor is useful in establishing the timing of the ignition system.

In yet another aspect of the present invention, a method for altering the ignition timing of an engine that has a centered gear tooth sensor installed therein includes replacing the centered gear tooth sensor with an offset gear tooth sensor.

In still another aspect of the present invention, an engine control system includes a microprocessor and an ignition system electrically connected thereto. A gear tooth sensor is also connected to the microprocessor. In this aspect, the gear tooth sensor includes means for altering the timing of the ignition system.

The present invention will now be described, by way of example, with reference to the accompanying drawings, in which:

DESCRIPTION OF AN EMBODIMENT OF THE INVENTION

Figure 1:
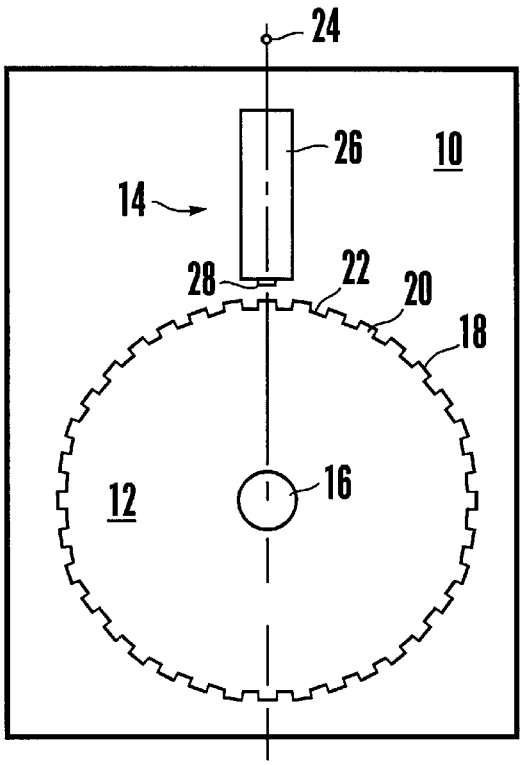
FIG. 1 is a plan view of a target wheel and a centered gear tooth sensor.

Referring initially to FIG. 1, an engine is shown and generally designated 10. Within the engine 10, are a target wheel 12 and a centered gear tooth sensor 14. FIG. 1 shows that the target wheel 12 is installed on a rotating shaft 16, e.g., a crankshaft, so that the target wheel 12 rotates therewith. As shown in FIG. 1, the target wheel 12 defines an outer periphery 18 that is alternatingly formed with plural teeth 20 and plural slots 22. FIG. 1 shows that the target wheel 12 also defines a center diametric axis 24.

As shown in FIG. 1, the centered gear tooth sensor 14 includes a housing 26 and a sensing element 28. The centered gear tooth sensor 14 is placed so that the sensing element 28 is just beyond the outer periphery 18 of the target wheel 12. Moreover, the sensor housing 26 and the sensing element 28 are aligned with the center diametric axis 24 of the target wheel 12.

Figure 2:
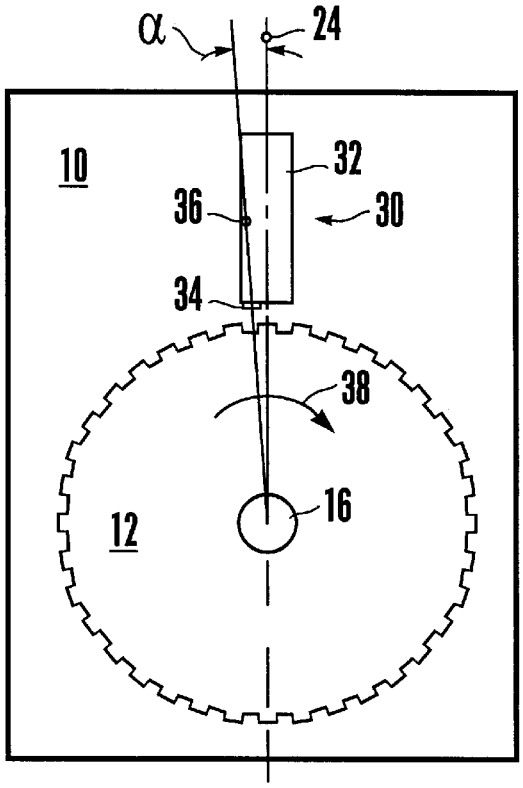
FIG. 2 is a plan view of a target wheel and an offset gear tooth sensor.

Referring now to FIG. 2, an offset gear tooth sensor 30 is installed in the engine 10 in place of the centered gear tooth sensor 14. FIG. 2 shows that the offset gear tooth sensor 30 includes a sensor housing 32 and a sensing element 34. As shown in FIG. 2, the offset gear tooth sensor 30 is placed just beyond the outer periphery 18 of the target wheel 12. The sensor housing 32 is aligned with the center diametric axis 24 of the target wheel 12. However, the sensing element 34 is offset from the center diametric axis 24 of the target wheel 12. More specifically, an offset angle, $\alpha$, is established between the diametric axis 24, which passes through the center of the housing 32, and a sensing axis 36, which passes through the center of the target wheel 12 and the center of the sensing element 34. As also shown in FIG. 2, the target wheel 12 rotates clockwise as indicated by arc 38.

Figure 3:
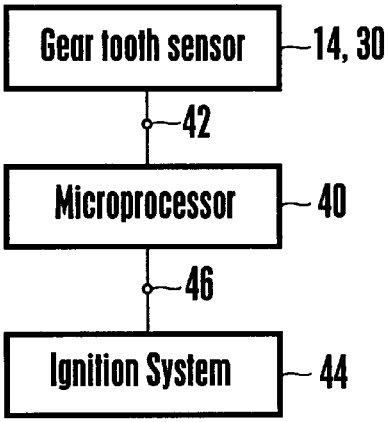
FIG. 3 is a block diagram of an engine control system.

FIG. 3 shows an engine control system in which either gear tooth sensor 14, 30 can be incorporated. FIG. 3 shows that the gear tooth sensor 14, 30 is connected to a microprocessor 40 via electrical line 42. In a preferred embodiment, the microprocessor 40 is an engine control module (ECM), but it is to be appreciated that it can be any type of microprocessor. FIG. 3 further shows an ignition system 44 connected to the microprocessor 40 via electrical line 46. The microprocessor 40 receives a signal from the gear tooth sensor 14, 30 representing the angular position of the target wheel 12 and the shaft 16 to which it is attached. The microprocessor 40 determines the position of the pistons based on the position of the crank shaft 16 as indicated by the sensing element 34 sensing the slots 22 and teeth 20 of the target wheel 12 as it rotates past the sensor 14, 30. The ignition system 44, in turn, receives signals from the microprocessor 40 representing the position of the pistons and ignites the spark plugs based thereon.

It is to be understood that the centered gear tooth sensor 14 can be considered a "stock" sensor, i.e., a gear tooth sensor that is standard equipment for a newly assembled vehicle. On the other hand, the offset gear tooth sensor 30 can be considered an "aftermarket" sensor, i.e., a gear tooth sensor that can be installed in the vehicle after the vehicle has been assembled and sold to a consumer.

Figure 4:
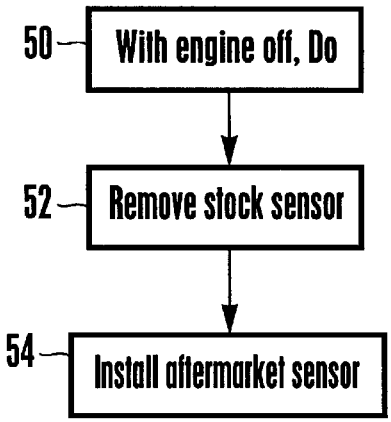
FIG. 4 is a flow chart of a method for advancing ignition spark timing.

Referring now to FIG. 4, a method for advancing the ignition timing of an engine is shown. Commencing at block 50, a do loop is entered wherein when the engine is off, the succeeding steps are performed. At block 52, the stock sensor, i.e., the centered gear tooth sensor 14, is removed from the engine. Proceeding to block 54, the aftermarket sensor, i.e., the offset gear tooth sensor 30, is installed in the engine. Thus, the stock sensor is replaced with the aftermarket sensor and the timing of the ignition is advanced by an amount equal to the offset angle, $\alpha$.

It is to be appreciated that since the target wheel 12 rotates clockwise, as indicated by arc 38 in FIG. 2, moving the sensing element 34 to the left of the center diametric axis 24 advances the ignition timing. However, moving the sensing element 34 to the right of the center diametric axis 24 retards the ignition timing.

With the configuration of structure described above, it is to be appreciated that the centered gear tooth sensor 14 can be relatively easily and inexpensively replaced by the offset gear tooth sensor 30. Thus, the ignition timing can be advance or retarded without the need for changing an expensive chip in the ECM.

While the particular SYSTEM AND METHOD FOR ALTERING ENGINE IGNITION TIMING as herein shown and described in detail is fully capable of attaining the above-described objects of the invention, it is to be understood that it is the presently preferred embodiment of the present invention and thus, is representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural and functional equivalents to the elements of the above-described preferred embodiment that are known or later come to be known to those of ordinary skill in the art are expressly incorporated herein by reference and are intended to be encompassed by the present claims. Moreover, it is not necessary for a device or method to address each and every problem sought to be solved by the present invention, for it is to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. section 112, sixth paragraph, unless the element is expressly recited using the phrase "means for."

What is claimed is:

1. A method for altering ignition timing of an engine, comprising the acts of:

shutting the engine off;

removing a centered gear tooth sensor from the engine; and installing an offset gear tooth sensor in place of the centered gear tooth sensor;

wherein the centered gear tooth sensor is centered with respect to a center diametric axis established within the engine and the offset gear tooth sensor is offset with respect to the center diametric axis such that it alters the ignition timing of the engine.

2. The method of claim 1, wherein the offset gear tooth sensor advances the ignition timing.

3. The method of claim 1, wherein the offset gear tooth sensor retards the ignition timing.

4. The method of claim 1, wherein the engine includes a target wheel attached to a rotating shaft, the target wheel defines a center diametric axis, and the offset gear tooth sensor includes a sensor housing that is aligned with the center diametric axis and a sensing element that forms a sensing angle with respect to the center diametric axis.

5. A method for altering ignition timing of an engine having a centered gear tooth sensor installed therein comprising the acts of:

installing an offset gear tooth sensor in place of the centered gear tooth sensor;

wherein the centered gear tooth sensor is centered with respect to a center diametric axis established within the engine and the offset gear tooth sensor is offset with respect to the center diametric axis such that it alters the ignition timing of the engine.

6. The method of claim 5, wherein the offset gear tooth sensor advances the ignition timing.

7. The method of claim 5, wherein the offset gear tooth sensor retards the ignition timing.

8. The method of claim 5, wherein the engine includes a target wheel rigidly attached to a rotating shaft, the target wheel defines a center diametric axis, and the offset gear tooth sensor includes a sensor housing that is aligned with the center diametric axis and a sensing element that forms a sensing angle with respect to the center diametric axis.

9. A method for altering ignition timing of an engine, comprising the acts of:

shutting the engine off, the engine including a target wheel attached to a rotating shaft, the target wheel defining a center diametric axis;

removing a centered gear tooth sensor from the engine; and installing an offset gear tooth sensor in place of the centered gear tooth sensor; the offset gear tooth sensor including a sensor housing that is aligned with the center diametric axis and a sensing element that forms a sensing angle with respect to the center diametric axis.

10. The method of claim 9, wherein the offset gear tooth sensor advances the ignition timing.

11. The method of claim 9, wherein the offset gear tooth sensor retards the ignition timing.

12. A method for altering ignition timing of an engine having a target wheel rigidly attached to a rotating shaft, the target wheel defining a center diametric axis, the engine having a centered gear tooth sensor installed therein, the method comprising the acts of:

installing an offset gear tooth sensor in place of the centered gear tooth sensor; the offset gear tooth sensor including a sensor housing that is aligned with the center diametric axis and a sensing element that forms a sensing angle with respect to the center diametric axis.

13. The method of claim 12, wherein the offset gear tooth sensor advances the ignition timing.

14. The method of claim 12, wherein the offset gear tooth sensor retards the ignition timing.

* * * * *